US005557253A

United States Patent [19]

Hegemann et al.

[11] Patent Number: 5,557,253

[45] Date of Patent: Sep. 17, 1996

[54] OFFICIATING COMMUNICATION DEVICE

[75] Inventors: Kenneth J. Hegemann, Carlsbad, Calif.; Max M. Stern, 24284 Ontario La., El Toro, Calif. 92630

[73] Assignee: Max M. Stern, Lake Forest, Calif.

[21] Appl. No.: 299,294

[22] Filed: Sep. 1, 1994

[51] Int. Cl.[6] ..... G08B 23/00

[52] U.S. Cl. ..... 340/321; 340/321; 340/323 R

[58] Field of Search ..... 340/321, 323 R, 340/539; 116/173; 273/311; 200/238, 255

[56] References Cited

U.S. PATENT DOCUMENTS 4,541,013 9/1985 Alpert ..... 340/323 R 4,785,282 11/1988 Martell et al. ..... 340/323 R 5,408,221 4/1995 Carsella, Sr. et al. ..... 340/604

*Primary Examiner*—Jeffery Hofsass

*Assistant Examiner*—Julie B. Lieu

*Attorney, Agent, or Firm*—John J. Murphey, Esq; Murphey Law Offices

[57] ABSTRACT

This invention concerns a device for confirming an official's call in a field sport, including a flag for waving to visually indicate to others that the event has occurred, a shaft upon which the flag is loosely attached, a handle to support the shaft integral therewith, a power source, an electronic signal generator and transmitter, and a receiver worn by another offical for receiving the signal in confirmation of the official's call.

12 Claims, 3 Drawing Sheets

OFFICIATING COMMUNICATION DEVICE

BACKGROUND OF THE INVENTION

Field of the Invention

This invention pertains to the field of sporting events. More particularly, it relates to a device that is used by one game official to confirm a foul or other action, to another official, having taken place on the playing field. This allows the game official to stop play until the foul or other action has been dealt with pursuant to the rules of the game.

Description of the Prior Art

In many sporting field events, there are a plurality of officials, each with his or her own sector of responsibility and generally reportable to a senior official. In the normal course of the sporting event, at the occurrence of a foul or other action, the official observing the situation waves a flag or blows a whistle signifying his/her observance thereof and notifying the other officials accordingly. The senior official then stops play and the various officials confer among themselves to determine the appropriate action, such as a penalty for the individual or team who has committed the foul.

Sporting field events are constantly attracting more and more spectators. As the fervor of the game rises, the cheering and enthusiasm of the spectators creates a sound background against which an official's whistle is often not discernable. In addition, the arm waving and other demonstrations of the various spectators often create sufficient commotion that one or more officials do not observe the waving of a foul flag or a flag indicating the occurrance of other action, such as for substituting of a player, an "off sides", an injury to a player, or a "throw-in" such as occurs in the game of soccer or rugby. This situation creates confusion during the playing of the game because generally, fouls cause a team to be penalized such that the other team has an improved chance for scoring a goal or otherwise as the condition calls for. The failure to assess the appropriate penalty provides a benefit to the errant team, thus creating an unfair advantage.

It is known in the art to transmit signals through electromagnetic means such as by cellular telephone or radio broadcast. However, these would not be usable in field sporting events because of the time taken by one official to dial or punch in the appropriate telephone number of the official to whom the signal is being sent. In addition, radio transmissions involve large areas and such a transmission by one official to another could create a significant detriment in the broadcasting field.

It is, however, known to modify a carrier frequency with a preplanned digital code such that the code is repeated, for instance every 30 microseconds, and will only be received and acted upon by a receiver having a decoder carrying the same code as that transmitted. All other receivers would ignore the code because the transmitted code would not trigger the decoding mechanism to process the incoming signal any further and it would be ground out in the receiver circuit. It is believed that such coded transmissions have not heretofore been considered as part of a field sporting event.

SUMMARY OF THE INVENTION

This invention is a novel transmission and reception device for sending a confirming signal from an official calling a foul or other situation to the lead official confirming that the situation was observed so as to remove from the sporting event the possibility of failing to have the senior official assess the appropriate penalty against the fouling team or action in response to the situation.

The invention includes a novel flag-waving device for use by the official who observed the situation. The waved flag is openly obvious to all other officials as well as the participants in the sporting event. However, to confirm that such a situation has been observed and declared, the unique device carries within its frame work a small, but powerful, discrete code transmitter that may be activated by the party waving the flag by merely pressing his/her thumb against a moveable portion of the handle of the device. An announcement means built into the device confirms to the user or flag-waving official, that indeed, he or she has transmitted a confirming coded signal.

The lead official receives the transmitted signal and wears a device that decodes the signal and initiates a notification device indicating that an appropriately coded signal has been transmitted from another official. The lead official may check with his other officials to determine what situation has been observed and thereafter take the appropriate action and keep the game moving along. Both the device worn by the notifying official and the device worn by the lead official are small in size, sturdy in construction and made from off-the-shelf products so that the complete ensemble is of modest price. A unique aspect of this invention is the ability of the notifying official to activate the code transmission by merely touching or pressing an elastomeric area surrounding the upper portion of the handle that supports the flag. This elastomeric covering houses an orbital switch that is yieldable 360° about the handle, thus allowing the official to activate the code transmission by the same hand that waves the flag and without taking his/her eyes off the playing field.

This inventive device generally comprises a flag for waving to visually indicate that a situation has been observed, a shaft on which the flag is loosely attached, a handle that supports the shaft and is integral therewith, means contained in the handle for radiating a discrete, coded, electromagnetic signal through an antenna that is housed in the shaft, and an orbital switch activated by the thumb of the hand waving the flag for energizing the radiation means to cause the electromagnetic signal to be broadcast from the antenna.

Accordingly, the main object of this invention is a simple and expeditious means of quietly confirming the occurrence of a situation in a sporting field event such that the officials need not take their eyes from the playing field. Other objects of the invention include a compact device for carrying by the observing official and useful throughout the entire field of play for transmitting a discrete coded signal to the lead official to confirm the occurrence of the situation; a means of permitting a confirming signal to be transmitted utilizing the same hand of the observing official that is used to wave the flag that indicates the occurrence of the foul or happening of some other significant event; a means of utilizing electromagnetic energy in a specific manner that does not interfere with the use of such radio and electromagnetic waves by others at field sporting events or otherwise; a confirming device that does not require significant training in the use thereof; a device that is inexpensive to manufacture from off-the-shelf items; a device that will improve the accuracy and hence the sporting basis for field sporting events and the officiating thereof such that play may be interrupted when in fact a situation has occurred and the appropriate action is taken without undue demonstrations from the officiating corps.

These and other objects of the invention will become more apparent upon reading the description of the preferred embodiments taken with the drawings appended hereto. The scope of protection sought by the inventors may be gleaned from a fair reading of the claims that conclude this specification.

DESCRIPTION OF THE PREFERRED EMBODIMENT

Figure 1:
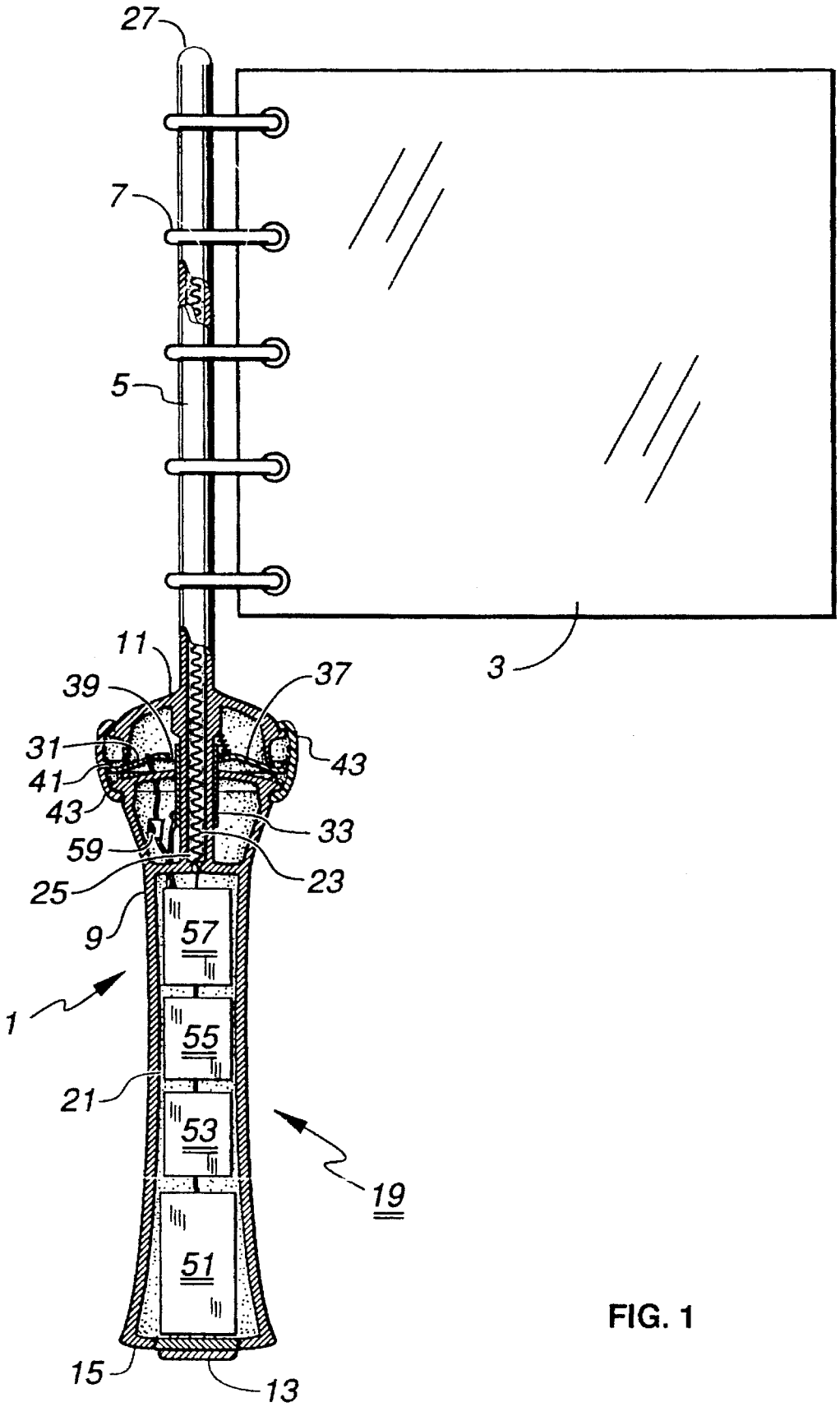
FIG. 1 is an illustrative view, partly in section, of the preferred embodiment of the novel device of this invention that is used by the observing official.

Turning to the drawings wherein like elements are identified by like numerals throughout the four figures, FIG. 1 shows the preferred embodiment of the transmitting device 1 of this invention and shows it to generally comprise a flag 3 for waving by the witnessing official to visually indicate to others that a foul or other situation has occured that requires stoppage of play. Flag 3 is usually of a specific color and size such as 10 inches by 10 inches, and made of a material that will withstand the rigors of field sporting events. A shaft 5 is provided on which flag 3 is loosely attached by a variety of means such as rings 7 shown in FIG. 1. Other attachment devices such as string, ribbons, wire, etc., may be used and are fully within the scope of this invention.

A handle 9 is provided that supports shaft 5 at its upper terminal end 11. Preferably, shaft 5 and handle 9 are molded as a unitary piece in generally tubular form with shaft 5 being of narrower diameter and handle 9 being of a size that is easily carried and manipulated by an adult's hand. A plug 13 is conveniently provided at the lower end 15 of handle 9 for insertion of numerous elements necessary to the proper utilization of the invention as will more clearly hereinafter be set forth.

A means 19 for generating and radiating a discrete electromagnetic signal are generally shown in block form are housed in a container 21 molded or formed in the lower part of handle 9. An antenna 23 extends upward from said container 21 through a bore 25 formed interior of shaft 5 and extends towards the top end 27 of said shaft.

Figure 2:
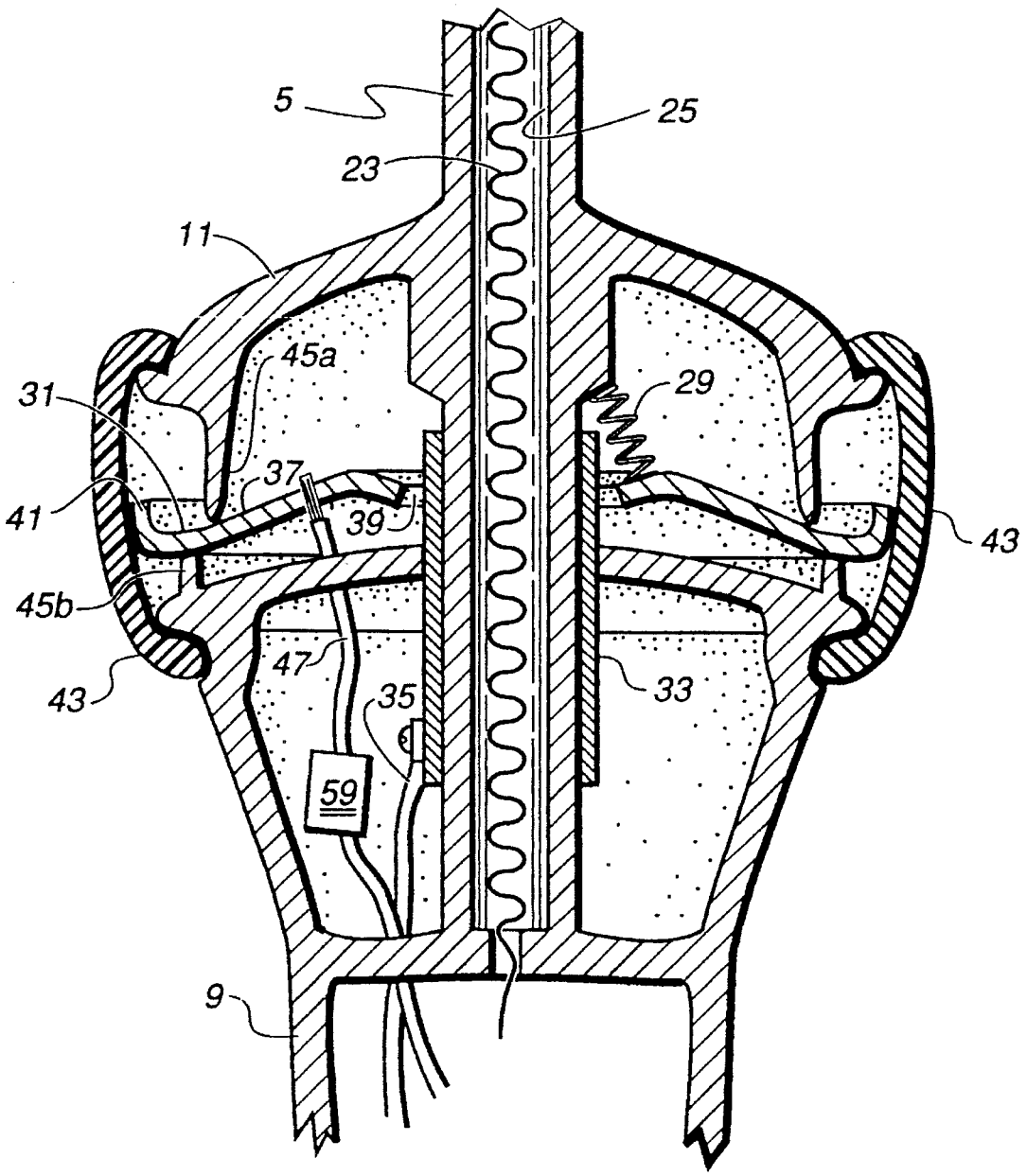
FIG. 2 is an illustrative view of the orbital switch that is a part of the embodiment shown in FIG. 1.

A unique orbital switch 31 is constructed near handle upper end 11 and, as more clearly shown in FIG. 2, comprises an electrically conducting sleeve 33 annularly disposed about shaft 5 interior upper handle end 11. As shown, a first wire conductor 35 is connected to sleeve 33 and extends downward to one side of the electrical circuitry of means 19. A disk 37 is mounted inside upper handle end 11 having a central aperture 39 formed therein that is annularly disposed about sleeve 33. The outer peripheral edge 41 of disk 37 is turned out of the plane of said disk and covered over by an elastomeric membrane 43 that is positioned on the outside of handle 9. Said elastomeric membrane is conveniently made of rubber or rubber-plastic blends. Said membrane is preferably glued into place to prevent ingress of water or moisture to the electrical components inside handle 9. In another embodiment, the entire exterior surface of handle 9 may be covered with an elastomeric membrane to make it less likely to slip out of one's hand and to further ensure the interior of said handle remains dry and free from influx of moisture that could be detrimental to the electronic components housed interior thereof.

A pair of solid walls **45*a* and 45*b* are molded or otherwise established respectively above and below disk 37 and engage said disk in sliding relationship to retain said disk in a substantially horizontal plane, perpendicular or normal to the elongated axis of handle 9. Membrane 43 engages the outer peripheral edge 41 of disk 37 and retains it centrally about sleeve 33 so that no portion of said disk is in physical contact with said sleeve. If required, disk 37 may be further supported by bias means, such as a spring 29 shown in FIG. 2, to centralize it about sleeve 33. Disk 37 is shown in FIG. 2 to be attached to a second wire conductor 47 that is in electrical contact with the other side of the electrical circuit making up means 19**.

As can be readily seen by this construction, elastomeric membrane 43, and possibly spring 29, retains orbital switch 31 in a positive neutral position where the respective conductors are not in electrical contact. The thumb of the user who grasps handle 9 to wave the flag may be used to depress elastomeric membrane 43 anywhere 360° about handle 9 to close disk 37 against sleeve 33 and initiate the transmission of the discrete, coded, electromagnetic signal. Upon release of the thumb, the resilience of elastomeric membrane 43 forces disk 37 back into its neutral, open position so that means 19 does not continue to transmit.

It is noted that handle 9 and shaft 5 constitute an elongated, tubular device. In the field of outdoor sporting activities, there is much jumping, running, tumbling and jostling. Accordingly, it is not too uncommon for such energetic activity to encompass one or more officials and these officials have been known to get knocked over or involved in a large piling of bodies. In the manufacture of this inventive device, care should be taken to ensure that shaft 5 is made of easily collapsible material, strong enough to support the vigorous waving of a flag but easily breakable enough to collapse and be of no dangerous proportions when involved in the collision between two or more individuals.

Means 19 for generating the discrete, electromagnetic signal generally includes a power source 51, preferably in the form of one or more electric batteries that are easily inserted and carried in lower end 15 of handle 9. Said handle upper end 11 and lower end 15 are arranged in spaced-apart relation as shown in FIG. 1. Such a positioning of the heavy batteries renders device 1 a more convenient, bottom-heavy device easily manipulated by the hand. A code generator 53 is electrically connected to said power source and will, when energized, generate a discrete pattern modulated within a specific frequency carrier. In addition, code generator 53 is preferably combined with an EEPROM (Electrically Erasable Programmable Read Only Memory) 55 on which may be encoded a specific code for use in a specific sporting event.

A transmitter 57 is next connected to code generator 53 and EEPROM 55 to provide a specific frequency carrier. Antenna 23 is connected to transmitter 57 and physically extends up through bore 25 in shaft 5 for the purpose of transmitting the specific coded signal. All of the aforesaid electronic items presently exist in the prior art and may be purchased from a retail outlet such as Radio Shack, and electrically interconnected to perform the services set forth above.

A vibrator 59 is connected through second wire conductor 47 and mounted interior of handle 9. The purpose of vibrator 59 is to provide a physical indication to the observing official that he/she has, in fact, transmitted a confirming signal to the lead official. Vibrator 59 is an off-the-shelf item that is energized every time disk 37 is brought into electrical contact with sleeve 33. In lieu of vibrator 59, a feed-back receiver (shown at 59) may be interconnected transmitter 57 and provided with a flashable light or audible tone generator (part of 59) that will also activate upon the transmission of a coded signal from antenna 23. In either event, the function is to clearly indicate to the witnessing official that he/she has indeed performed their officiating duty in transmitting the confirming signal to the lead official.

Figure 3:
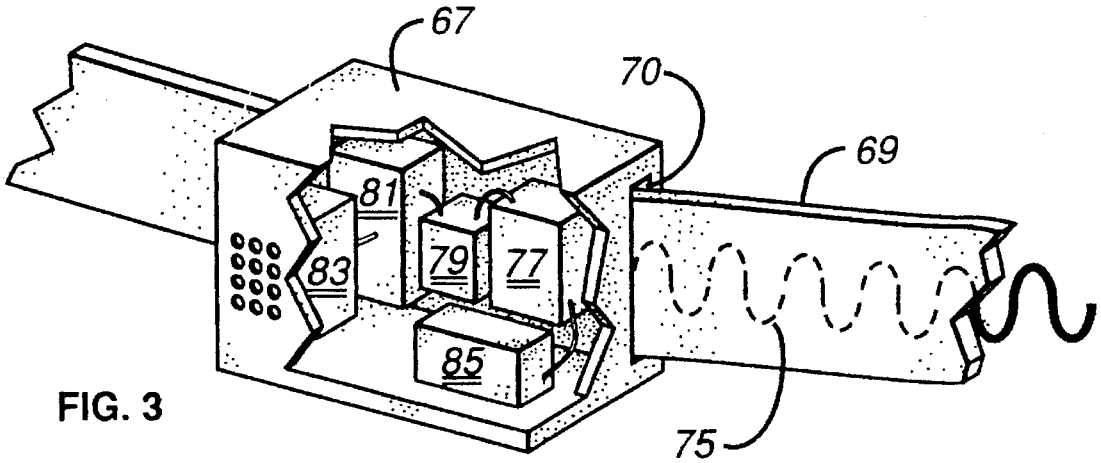
FIG. 3 is an illustrative view of the preferred embodiment of the enunciating device carried by the lead official for indicating that a confirming transmission has been made and received; and, FIG. 4 is an illustrative view of the preferred embodiment of the device worn by the lead official to receive and process the discrete coded signal and simultaneously therewith indicate to the wearer or lead official that such a signal has been received.
Figure 4:
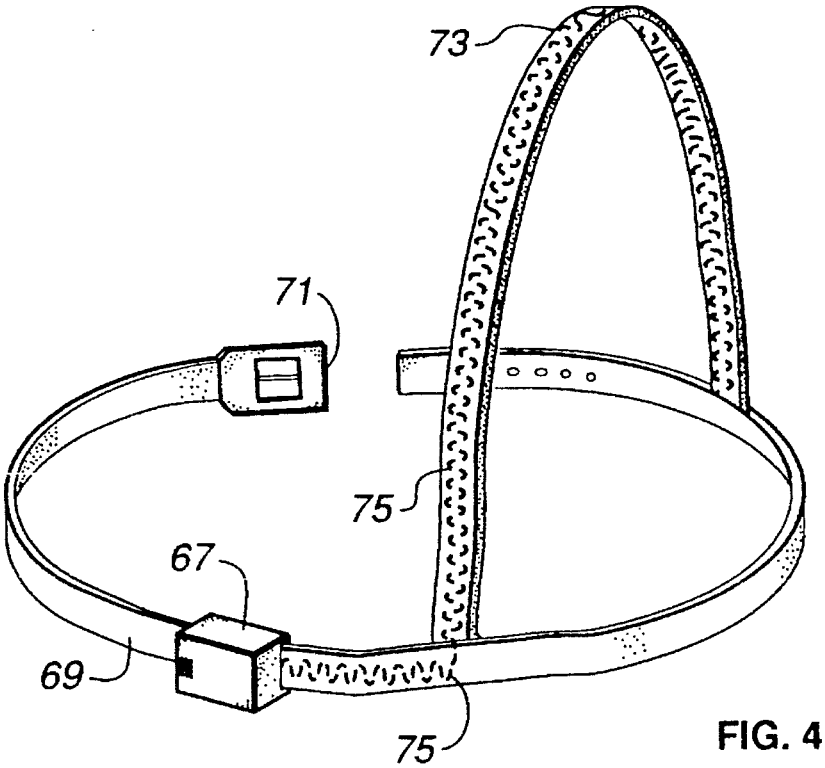

Shown in FIG. 3, is a receiving-notifying unit 67 to be worn by the lead official. As shown in FIG. 4, unit 67 is preferably mounted on a waist belt 69, having a buckle 71, and a shoulder strap 73. A receiving antenna wire 75 is embedded in shoulder strap 73 and electrically connected to unit 67 for receiving the coded transmission and transferring it into said unit.

Unit 67 contains a receiver 77 that is connected to antenna 75. A decoder 79 is provided for decoding the incoming transmission. A comparator 81 is connected to decoder 79 and compares the decoded signal with the code or codes previously inputted thereto that are agreed to be used by the officials of that particular event. A notification unit 83 is provided in unit 67 for activation to provide an audible or visual signal, such as a vibration or tone or flashing light, to the lead official indicating that a properly coded transmission has been received from a witnessing official. A power supply 85 is electrically connected to the other components therein to provide unit 67 with the requisite power. It is preferred that one or more batteries be used as power supply 85.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the way to achieve substantially the same result are within the scope of this invention.

What is claimed is:

1. In a field sporting event, a device for confirming an event comprising:

a) a flag for waving to visually indicate to others that an event has occurred;

b) a shaft upon which said flag is loosely attached;

c) a handle, for grasping with the hand, to support said shaft integral therewith;

d) means, integral with said handle, for radiating an electronic signal, to confirm said event, said means including an antenna; and, e) waterproof switch means, interconnected with said means for radiating said electronic signal, for initiating the transmission of the signal.

2. The device of claim 1 wherein said switch means is integral with said handle.

3. The device of claim 1 wherein said switch means includes an orbital activation member.

4. The device of claim 3 wherein said orbital activation member is activated by the same hand that waves the flag to confirm the occurrence of the event.

5. The device of claim 1 wherein said shaft is hollow and said antenna is positioned therein for radiating said signal.

6. The device of claim 1 wherein said handle is defined by spaced-apart upper and lower ends, wherein said switch means is located near said upper end of said handle and comprises:

a) an electrically conducting sleeve annularly disposed about said shaft, interior said upper handle end;

b) a first wire conductor connected to said sleeve and extending to one side of said means for radiating said signal;

c) a disk annularly disposed about said sleeve;

d) a second wire conductor connected to said disk and extending to the other side of said means for radiating said signal; and, e) an elastomeric membrane covering said disk and holding said switch in a neutralized position;

f) said switch being closable by pressing against said elastomeric membrane at any point 360° about said handle to bring said disk into electrical contact with said sleeve and close the circuit of said means for radiating said signal.

7. The device of claim 6 further including at least one wall disposed in said handle for retaining said disk in a substantially horizontal plane, normal to the elongated axis of said handle, to retain said disk centrally about said sleeve.

8. The device of claim 1 further including a container formed in said handle for receiving therein said means for radiating said electronic signal.

9. The device of claim 1 further including a feed-back receiver interconnected said means for radiating an electronic signal for receiving a portion of the transmitted signal, and an audible tone generator for indicating to the witnessing official that he/she has transmitted a confirming signal.

10. The device of claim 1 further including a receiving-notifying unit for wearing by another official, said unit comprising:

a) an antenna to receive the transmitted signal;

b) a receiver connected to said receiving antenna for receiving the signal; and, c) a notification unit for activation by said receiver to provide a signal to the official that a transmission has been received from a witnessing official.

11. The device of claim 10 wherein said notification unit produces a signal audible to the wearer.

12. In a field sporting event, a device for confirming an event comprising:

a) a flag for waving to visually indicate to others that an event has occurred;

b) a shaft upon which said flag is loosely attached;

c) a handle to support said shaft integral therewith;

d) means, integral with said handle, for radiating an electromagnetic signal, to confirm said event, said means including an antenna; and, e) waterproof switch means integral with said handle including an orbital activation member for activating said signal radiation means at any point 360° about said handle;

f) wherein said switch means may be activated by the same hand that waves the flag to confirm the occurrence of the event.

* * * * *